US005622560A

United States Patent [19]

Haroutel et al.

[11] Patent Number: 5,622,560

[45] Date of Patent: Apr. 22, 1997

[54] DEVICE FOR UNIFORMLY MOISTENING ADHESIVE LABELS

[75] Inventors: Jean-Claude Haroutel, Orsay; Jacques Bastien, Osny, both of France

[73] Assignee: Neopost Industrie, Bagneux, France

[21] Appl. No.: 998,041

[22] Filed: Dec. 29, 1992

[30] Foreign Application Priority Data

Dec. 31, 1991 [FR] France ..... 91 16369

[51] Int. Cl.[6] ..... B05C 1/00

[52] U.S. Cl. ..... 118/216; 118/225; 156/390; 156/578

[58] Field of Search ..... 156/578, 356, 156/390, 441.5, 529, 547, 548; 118/208, 216, 255, 264, 268, 401

[56] References Cited

U.S. PATENT DOCUMENTS 2,241,104 5/1941 Grinten ..... 118/401 X
2,717,574 9/1955 Bore ..... 118/401
4,380,210 4/1983 Auerbach ..... 118/264 X
4,773,962 9/1988 Garrigue et al. ..... 156/441.5

FOREIGN PATENT DOCUMENTS 0293316 11/1988 European Pat. Off. .
1247177 8/1967 Germany .

*Primary Examiner*—David A. Simmons
*Assistant Examiner*—M. Curtis Mayes
*Attorney, Agent, or Firm*—Sughrue, Mion, Zinn, Macpeak & Seas

[57] ABSTRACT

The invention relates to a device for moistening labels that have one face coated with adhesive, the device serving to moisten the adhesive-coated face of the labels in uniform manner. The device includes a moistening element constituted by a rigid bar whose top portion is in contact with the adhesive-coated face of the labels and which is split by capillarity slits extending in the running direction of the labels over the bar and whose respective bottoms are immersed in a moistening liquid maintained at constant depth.

6 Claims, 1 Drawing Sheet

DEVICE FOR UNIFORMLY MOISTENING ADHESIVE LABELS

The invention relates to a device for uniformly moistening a flexible strip such as a strip of paper or any other flexible medium previously coated with adhesive and used for paying postage dues on letters, packets, and parcels, for wrapping purposes, or for labelling.

BACKGROUND OF THE INVENTION

The devices for moistening an adhesive strip that are the most widespread, because they are the simplest, comprise a moistening element constituted by a sponge or a felt. It is known that this type of moistening element does not have long life. European patent application No. 0 293 316 describes a device for moistening adhesive labels that comprises a moistening element in the form of a brush constituted by a sheet of bristles. The brush is placed in a vessel filled with moistening liquid suitable for diluting the adhesive. The bottom portion of the brush is immersed in the moistening liquid which is maintained at constant depth. The top portion of the brush as wetted by the liquid by capillarity is kept in contact with the adhesive-coated face of the labels as they run past the brush. Although such a brush has longer life than a sponge or a felt, it suffers from the drawback, over a period of time, of not distributing moistening liquid uniformly over the adhesive face of the labels because it picks up adhesive. The effect of wiping the adhesive face of the labels over the ends of the bristles of the brush is to cause adhesive to be deposited between the bristles of the brush. As a result the brush clogs up with adhesive that remains trapped between its bristles without any possibility of being moved as the labels go past. This gives rise to a poor transfer of moistening liquid onto the labels, with some portions of the adhesive-coated face of the labels being cleaned, so that in the course of time the moistening of the labels is not uniform.

The object of the invention is to provide a device for moistening a flexible strip, the device including a moistening element that does not present the above-mentioned drawbacks.

SUMMARY OF THE INVENTION

To this end, the invention provides a device for moistening a flexible strip having a face that is at least partially coated with adhesive, the device including a moistening member having a bottom portion immersed in moistening liquid and a top portion that is moistened by said liquid by capillarity, which top portion is in contact with the adhesive-coated face of said strip as it runs against said moistening element in a running direction, wherein the moistening element is a rigid bar whose top portion is split up by a plurality of capillarity slits extending in said running direction of the flexible strip and whose respective bottoms are immersed in the moistening liquid.

Such a rigid moistening element does not suffer from wear. Nor does it become clogged up since the fact that the capillary slits extend in the travel direction of the flexible strip makes it possible for adhesive residues to be removed continuously while the strip is running past by channeling the moistening liquid in the capillarity slits. The moistening of the flexible strip in the form of parallel lines of adhesive remains uniform over time.

According to another feature of the invention, the top of the bar is provided with grooves extending parallel to the capillarity slits and disposed between them, for the purpose of removing excess moistening liquid.

According to another feature of the invention, the bar is removably mounted to enable the vessel to be removed, if necessary.

According to another feature of the invention, the bar is made of thermoplastic material, e.g. an injected thermoplastic, thereby making it easy to manufacture and thus inexpensive.

According to yet another feature of the invention, the device for moistening a flexible strip further includes a guide member for the flexible strip mounted above the rigid bar to press the flexible strip against the top portion of the bar, said guide member being provided with a plurality of ribs facing the top portion of the bar, each rib extending parallel to the capillarity slits while not facing any of them. This position of the ribs relative to the capillarity slits makes it possible to guide the flexible strip appropriately while maintaining good quality transfer of moistening liquid to the flexible strip, i.e. avoiding moistening the non-adhesive face of the flexible strip.

Advantageously, each rib faces a groove so that the flexible strip is pressed against the bar at locations in which no moistening liquid is transferred to the flexible strip, so as to avoid damaging the strip.

BRIEF DESCRIPTION OF THE DRAWING

An embodiment of the invention is described by way of example with reference to the accompanying drawing, in which.

In the figures, the same numerical references are used to designate items that are identical.

DETAILED DESCRIPTION

Figure 1:
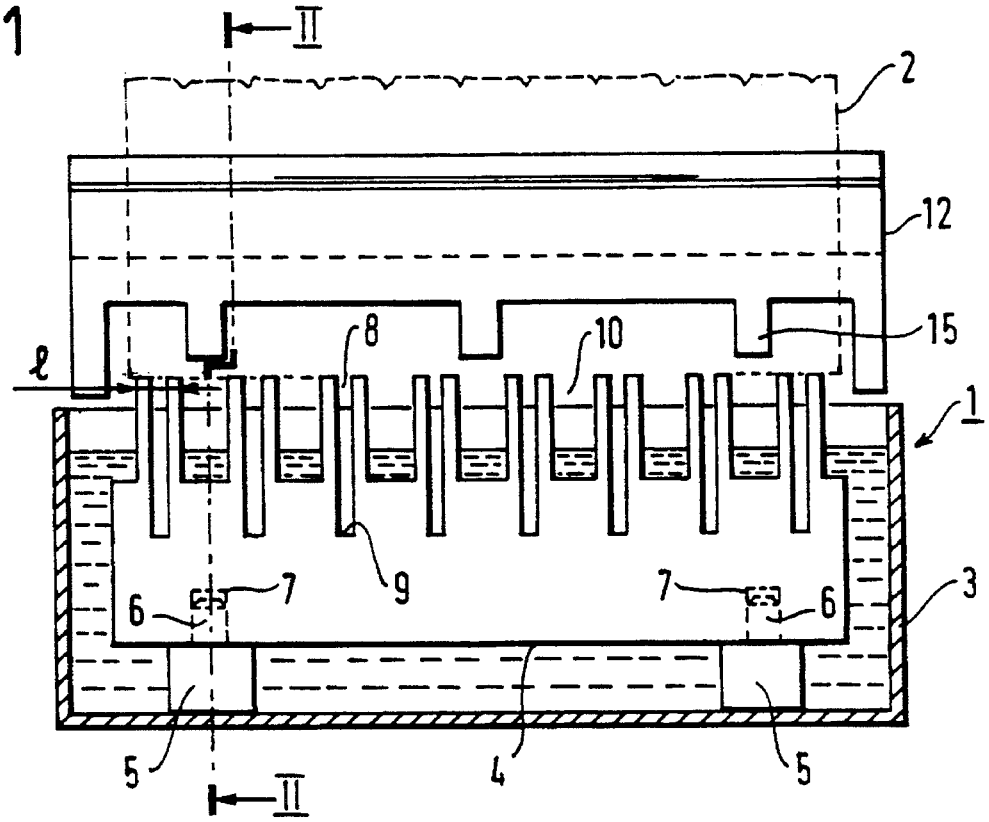
FIG. 1 is a diagrammatic end view of the device of the invention, with the vessel being shown in section.

In FIG. 1, the device 1 for moistening a flexible strip such as a strip of paper 2 having one face at least partially covered with adhesive, e.g. a label, comprises a vessel 3 in which a rigid bar 4 of generally rectangular shape is placed, the top portion of the bar projecting above the open top of the vessel. The rigid bar 4 stands on studs 5 secured to the bottom of the vessel, and it is held thereto by pegs 6 fixed to the studs 5 and constituting a force-fit in holes 7 formed in the bottom of the bar. This disposition means that the bar is removably mounted so as to enable it to be removed from the vessel, should that be necessary.

Figure 2:
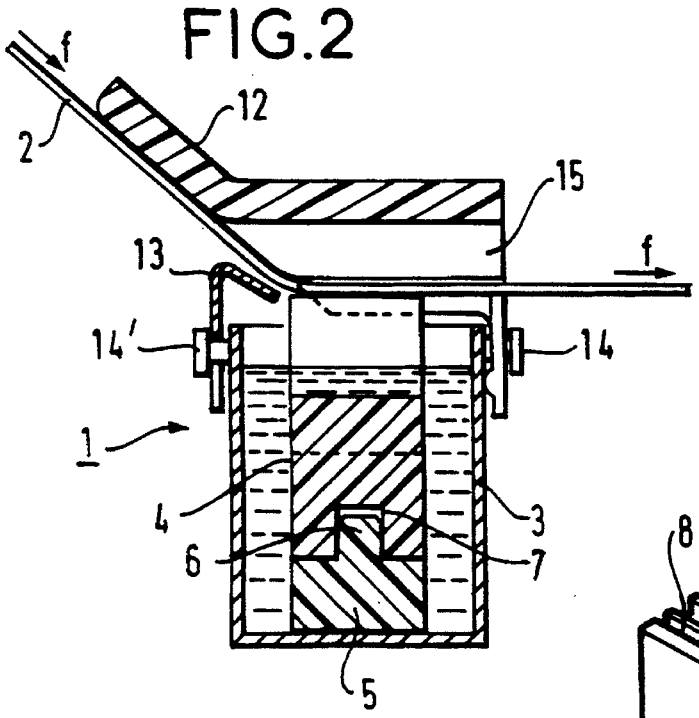
FIG. 2 is a diagrammatic cross-section on line II—II of FIG. 1.

The strip of paper is driven in conventional by a set of rollers and backing rollers (not shown). It runs over the bar in a running direction represented by arrows f, the running direction of the strip of paper being perpendicular to the longitudinal axis of the bar when in place in the vessel, as can be seen in FIG. 2. The face of the strip of paper that has previously been coated with adhesive faces the top of the rigid bar and comes flush therewith.

Figure 3:
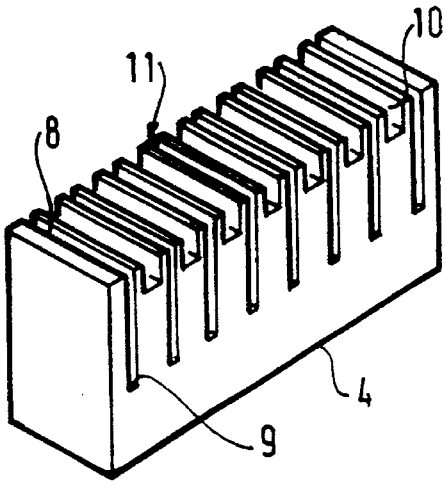
FIG. 3 is a perspective view of the rigid bar of the invention.

A plurality of substantially parallel capillarity slits 8 pass through the top portion of the bar and extend in the running direction of the strip of paper, as can be seen in FIG. 3. Each capillarity slit 8 opens out into the top face, the front face, and the back face of the bar. Naturally, it would be possible to design slits that open solely to the top face and the back face of the bar (i.e. the righthand face of the bar as shown in FIG. 2) to obtain the same effect.

The vessel 3 is filled with a moistening liquid such as a liquid for diluting the adhesive, e.g. water, and the level of the liquid in the vessel is kept constant by any appropriate means, such as described in European patent application EP 0 293 316, so as to ensure that the bottoms 9 of the slits are always immersed in the moistening liquid.

The comb-shaped bar may be made of injected thermoplastic material suitable for raising the moistening liquid from the bottoms of the capillarity slits by means of the force of capillarity all the way to the top face of the bar. It extends transversely relative to the travel direction of the strip of paper so that the top portion of the bar as moistened by said liquid due to capillarity forms lines of moistened adhesive on the adhesive-coated face of the strip of paper, said adhesive lines being substantially parallel to one another and extending in the running direction of the paper.

The top of the bar 4 is also provided with grooves 10 running parallel to the capillarity slits 8 and disposed between them. As can be seen in FIGS. 1 and 3, the grooves are wider than the open-topped capillarity slits and also shallower, so as to ensure that the rigid bar remains strong enough. It will thus be understood that each tooth 11 of the bar as formed between two grooves 10 is split by a slit 8 that may be very narrow (about 1 mm wide) such that the lines of moistening are very narrow but nevertheless wide enough to obtain appropriate adhesion from the strip of paper. The number of teeth and grooves is selected as a function of the width of the strip of paper and of the quality of the paper. In the figures, the bar 4 has eight capillarity slits 8 for moistening a strip of paper that is about 3 cm wide. The number of slits and of grooves may vary as a function of the width of the strip of paper. The running speed of the strip of paper, the depth of the dilution liquid for the adhesive relative to the bottoms of the open-topped capillarity slits and the width of the slits all enable the quantity of water deposited on the adhesive-coated face of the strip of paper to be adjusted.

As can be seen in FIGS. 1 and 2, a guide member for the strip of paper has a top portion 12 and a bottom portion 13 and is fixed to the vessel 3 by respective fixing screws 14 and 14', with said portions being disposed on opposite sides of the strip of paper 2. The top portion 12 of the guide member which is mounted above the strip of paper so as to press the strip of paper onto the top portion of the bar is provided with a plurality of ribs 15 that face the top portion of the bar 4. Each rib 15 extends parallel to the open-topped capillarity slits 8 but does not face any such slit, being preferably disposed to engage a groove 10. The top portion 12 of the guide member may also be mounted by means of a hinge so as to be capable of pivoting between a first position in which it lies over the strip of paper to press it against the top portion of the bar, and a second position in which it forms a deflector preventing the strip of appear from coming flush with the top portion of the bar.

Naturally, the invention is not limited to the embodiment described above and other variants could be provided without going beyond the ambit of the invention.

We claim:

1. In a device for moistening a flexible strip having a face that is at least partially coated with adhesive, said device including a moistening member having a bottom portion immersed in moistening liquid and a top portion that is moistened by said liquid by capillarity, said top portion being in contact with the adhesive-coated face of said flexible strip as said flexible strip runs against said moistening element in a running direction, said top portion being split up by a plurality of laterally spaced, open-topped, vertical capillarity slits extending in said running direction of the flexible strip and having respective bottoms immersed in the moistening liquid; the improvement wherein:

the top portion of the moistening member is further provided with grooves extending parallel to the capillarity slits and being disposed respectively between said slits for removing excess of moistening liquid coming from the capillarity slits and flowing onto the top portion of the moistening member.

2. A device according to claim 1, in which said grooves are wider and shallower than said open-topped capillarity slits.

3. A device according to claim 2, wherein said moistening member is a rigid bar.

4. A device according to claim 3, further comprising a vessel holding said moistening liquid, and means for removably mounting said bar within said vessel.

5. A device according to claim 3, in which the bar is made of thermoplastic material.

6. A device according to claim 1, further including a guide member for the flexible strip mounted above the moistening member to press the flexible strip against the top portion of a moistening member, and said guide member being provided with a plurality of ribs facing the top portion of the moistening member, each rib extending parallel to the capillarity slits, being laterally offset from said capillarity slits and facing a respective groove.

* * * * *